United States Patent [19]

Hutchinson

[11] Patent Number: 5,075,938

[45] Date of Patent: Dec. 31, 1991

[54] FASTENING DEVICE

[76] Inventor: T. Gordon Hutchinson, P.O. Box 250, Dublin, N.H. 03444

[21] Appl. No.: 584,196

[22] Filed: Sep. 18, 1990

Related U.S. Application Data

[63] Continuation-in-part of Ser. No. 535,872, Jun. 11, 1990.

[51] Int. Cl.[5] ..... A44B 17/00

[52] U.S. Cl. ..... 24/464; 24/108; 24/470

[58] Field of Search ..... 24/464, 470, 453, 477, 24/297, 108, 465, 466, 467, 468, 469

[56] References Cited

U.S. PATENT DOCUMENTS

| | | | |
|---|---|---|---|
| 781,430 | 1/1905 | Kellogg | 24/470 |
| 1,076,675 | 10/1913 | Jennings | 24/470 |
| 1,570,625 | 1/1926 | Eddins | 24/464 |
| 2,937,834 | 5/1960 | Orenick et al. | 24/464 |
| 3,530,550 | 9/1970 | White | 24/464 |
| 3,644,965 | 2/1972 | Kahn | 24/108 |

FOREIGN PATENT DOCUMENTS

| | | | |
|---|---|---|---|
| 0943699 | 12/1963 | United Kingdom | 24/464 |

*Primary Examiner*—Victor N. Sakran

*Attorney, Agent, or Firm*—George W. Dishong

[57] ABSTRACT

A two part or component fastening device or apparatus wherein reliance is on the deformation of an oval/ellipse shaped aperture which deformation results from the insertion of a stud component into the aperture which is formed within a socket component. The present invention permits the attachment of two components and the release of such attached components both steps being achievable using the squeezing or pinching forces on only the periphery of a so called socket component and exertable with the use of one hand; more specifically the use of the fingers of one hand. More particularly, the invnetion disclosed herein is very simply based upon the deformation by a substantially cylindrical shaped member of an oval or elliptically cross-sectioned aperture which results in forces, due to the deformation and due to the characteristics of the material in which the aperture in located, which cause two components, a stud component and a socket component, to interengage and the interengagemeent can be caused to be released by the simple squeezing or pinching of only the socket component using the fingers of one hand. The fastener of the instant invention can thus be engaged and disengaged having access to only the socket component.

13 Claims, 3 Drawing Sheets

FASTENING DEVICE

BACKGROUND OF THE INVENTION

This application is a continuation-in-part of design patent application Ser. No. 535,872, filed on June 11, 1990, the disclosure of which is hereby incorporated by reference.

FIELD OF THE INVENTION

This invention most generally relates to a two part device to fasten together a plurality of sheets of material, such as for example paper, which may have but need not have previously made holes in them. The device is composed of plastic, metal or other similar material which is resilient but form retaining. The concept used to provide the snap fastening feature is the deformation of an ellipse or oval into a circle when the stud/male component of the fastener is pressed into the socket/female component which component has an elliptically shaped or oval shaped opening until the fastener is used. The closing of the fastener causes the deformation of the ellipse/oval into an approximate circle and the stresses created provide the forces necessary to keep the fastener securely together providing the means for holding together the articles being attached to each other such as for example papers, items of fabric, shoetop parts, etc.

DESCRIPTION OF THE PRIOR ART

Presently there is nothing available that permits the attachment of two components and the release of such attached components both steps being achievable using the squeezing or pinching forces on only the periphery of a so called socket component and exertable with the use of one hand; more specifically the use of the fingers of one hand. The invention disclosed herein is based upon the deformation by a substantially cylindrical shaped member of an oval or elliptically cross-sectioned aperture which results in forces, due to the deformation and due to the characteristics of the material in which the aperture in located, which cause two components, a stud component and a socket component, to interengage and the interengagement can be caused to be released by the simple squeezing or pinching of only the socket component using the fingers of one hand. In contrast, the prior art devices require pressure in the direction which is opposite to the direction of the insertion force and very importantly they require access to both components used in the clamping system. The fastener of the instant invention can thus be engaged and disengaged having access to only the socket component.

The following United States Patents have been reviewed relative to the invention disclosed and claimed herein.

U.S. Pat. No. 3,530,550 to White discloses a clamp composed of mating discs for engaging pliant sheet material, such as for fastening baby diapers without the use of pins or the like, and interengaging members provided on the discs for holding them together until released by pressure. An interconnecting flexible strap holds the discs together when they are not in clamping engagement. The opposed mating discs are frictionally held together when in clamping position and released by finger and thumb pressure of the user in a direction along the aperture axis. White relies on the material characteristics to provide the means for disengagement of 22 from 26.

U.S. Pat. No. 4,825,516 to Ackermann et al, teaches a snap-fastener comprising stud and socket components. This invention teaches the notion of placing a pliant substrate of material in such a position so that when the stud and socket components are closed they "pinch" the material therebetween.

The U.S. Pat. Nos.: 3,626,955 to Greenwood; 1,276,030 to Adler; 3,039,471 to Church; 2,583,224 to McDonald; and 2,590,175 to Hajdu were also reviewed.

The present invention as disclosed and claimed herein has clear and unobvious advantages over all of the prior art known to the Applicant.

SUMMARY OF THE INVENTION

The present invention in its most simple form or embodiment is directed to a two part or component fastening device or apparatus wherein reliance is on the deformation of an oval/ellipse shaped aperture which deformation results from the insertion of a stud component into the aperture which is formed within a socket component. The present invention permits the attachment of two components and the release of such attached components both steps being achievable using the squeezing or pinching forces on only the periphery of a so called socket component and exertable with the use of one hand; more specifically the use of the fingers of one hand. More particularly, the invention disclosed herein is very simply based upon the deformation by a substantially cylindrical shaped member of an oval or elliptically cross-sectioned aperture which results in forces, due to the deformation and due to the characteristics of the material in which the aperture in located, which cause two components, a stud component and a socket component, to interengage and the interengagement can be caused to be released by the simple squeezing or pinching of only the socket component using the fingers of one hand. The fastener of the instant invention can thus be engaged and disengaged having access to only the socket component.

A primary object of the invention is to provide a fastening device comprising: a stud component; a socket component fabricated using material which is resilient by form retaining having a dimensionally deformable aperture therein adapted to receive and interengage the stud component when the stud component is inserted into the socket component. The stud component and the socket component are adapted to clamp material between them when the stud component is inserted into the socket component. The stud component comprises a body portion, a substantially cylindrical shaped stud member projecting therefrom and means for deforming the aperture causing the aperture to receive and interengage the stud component when the stud component is inserted into the socket component. The stud and said socket component are thus interconnected. Also provided is an interengaging means adapted to cooperate with the socket component to interengage the stud and the socket components. The socket component aperture has interior walls, a major axis dimension and a minor axis dimension. The major axis dimension is greater than the minor axis dimension. The aperture axes dimensions are deformable so that the minor axis dimension increases as the major axis dimension decreases upon insertion and removal of the stud component into and from the socket component.

Another primary object of the present invention is to provide the fastening device as above described wherein the interengaging means comprises appropriately treated surfaces of the stud member and the interior walls defining the aperture are such that stud and socket interengagement results from friction forces between tangential contacting areas of the treated surfaces and the interior walls when the stud component is deformingly inserted into the socket component. The forces are substantially created by the deformation of the aperture and the resilience of the material.

Yet another primary object of the present invention is to provide the fastening device as described above wherein the means for deforming the aperture comprises an appropriate taper of the aperture interior walls so that the minor axis dimension is increased and the major axis dimension is decreased causing the aperture to admit the stud member thus interengaging the stud and the socket component. The stud component may be fabricated using material which is resilient but form retaining.

A particular object of the present invention is to provide the fastening device as described above wherein the interengaging means comprises: a disc interengaging means integral with and at the protruding end of the stud member. The disc interengaging means has an inner and an outer diameter. The inner diameter being greater than the outer diameter and greater than the stud diameter. The socket component is further adapted to have a means for engagement which matingly cooperates with the disc interengaging means of the stud component. The stud and socket interengagement results from forces between tangential contacting areas of the disc interengaging means and the means for engagement of the socket component when the stud component is deformingly inserted into the socket component causing deformation of the aperture. The forces are created by the deformation of the aperture and the resilience of the material.

A more particular object of the present invention is to provide the fastening device as described above wherein the means for deforming the aperture comprises an appropriate thickness dimension and inner and outer diameter relationship of the disc interengaging means providing an adequate taper to cause the aperture deformation upon inserting of the stud component and wherein the stud component is fabricated using material which is resilient but form retaining. Further, there is provided a means for flexibly connecting the stud component to the socket component.

An object of the present invention is to provide a fastening device comprising: a stud component having a body portion, a substantially cylindrical shaped stud member with a vertical length and a stud diameter and extending substantially vertically from a first inner surface and a disc interengaging means integral with and at the protruding end of the stud member. The disc interengaging means has an inner and an outer diameter the inner diameter being not less than the outer diameter and greater than the stud diameter. A socket component is fabricated using material which is resilient but form retaining adapted to interfit and interengage with the stud component, and having an arcuate interior aperture surface defining an aperture through the socket component with a vertical aperture axis substantially in parallel alignment with the stud member. The aperture having a vertical length not greater than the stud member length, a minor axis having a dimension greater than the outer diameter of the disc interengaging means and not greater than the stud diameter, and a major axis dimension greater than and orthogonal to the minor axis. One-half the sum of the major and minor axes dimensions being greater than the inner diameter and both the axes orthogonal to the vertical aperture axis. The aperture axes dimensions are deformable so that the minor axis dimension increases as the major axis dimension decreases upon insertion and removal of the stud component into and from the socket component. The stud component and the socket component adapted to clamp material between them when the stud component is inserted into the socket component.

Another object of the present invention is to provide the fastening device as described above wherein the stud component is fabricated using material which is resilient but form retaining and further, the socket component is adapted to have a means for engagement which matingly cooperates with the disc interengaging means of the stud component. The stud and socket interengagement results from forces between tangential contacting areas of the disc interengaging means and the means for engagement of the socket component when the stud component is deformingly inserted into the socket component causing deformation of the aperture. The forces created by the deformation of the aperture and the resilience of the material. Additionally, there may be provided means for flexibly connecting the stud component to the socket component.

A basic object of the present invention is to provide a method for engageably and releasably attaching together two components, the stud component and the socket component of the fastening device as above described. The method comprises the steps of: deformingly inserting the cylindrical shaped stud member into the aperture causing the aperture to deform to receive the cylindrical shaped stud member. The deformation of the aperture and the resilient material provide forces which cause the interengaging means to interengage the stud and the socket components. Additionally, squeezing or pinching the socket component in a manner so as to deform the aperture and release the forces thus releases the interengaging means. The aperture deformation is from a substantially non-cylindrical aperture to an aperture which is sized to allow the removal of the stud component from the socket component. The method may further comprise the clamping of substantially flat material between the socket component and the stud component when the stud component is inserted into the socket component.

These and further objects of the present invention will become apparent to those skilled in the art to which this invention pertains and after a study of the present disclosure of the invention.

DESCRIPTION OF THE PREFERRED EMBODIMENTS

The following is a description of the preferred embodiment of the invention. It is clear that there may be variations in the size and the shape of the apparatus. However, the main features of the device/apparatus is the deformation of the cross section of an aperture from being substantially oval or elliptical toward a more circular cross section. The degree of deformation will be dependent upon the intended use of the fastening device. The more the deformation the greater will be the clamping or the holding power of the device. The power of the device will also be a function of the material characteristics from which the two basic components are made. The device can be interengaged and disengaged with the use of one hand and with access to only the socket component of the device. A simple "pinching" action will result in the disengagement of the components.

In order to describe the invention most clearly and simply, the fastening device 10 will be described as being substantially a circular shaped device with basically two components—a stud component 15 and a socket component 20 both of which are designed or adapted to clamp material between them when the components are fastened together. The two components may be interconnected by flexible connector 8. Clearly where there is access only to one side of materials being clamped together or otherwise assembled or fastened, the connector 8 would not be used. However, if the device 10 is being used in a manner similar to paper clips where each of the sheets to be attached by use of the device 10 may or may not have a hole punched at any predetermined location around the periphery, connector 8 may be a part of the device 10.

Figure 1:
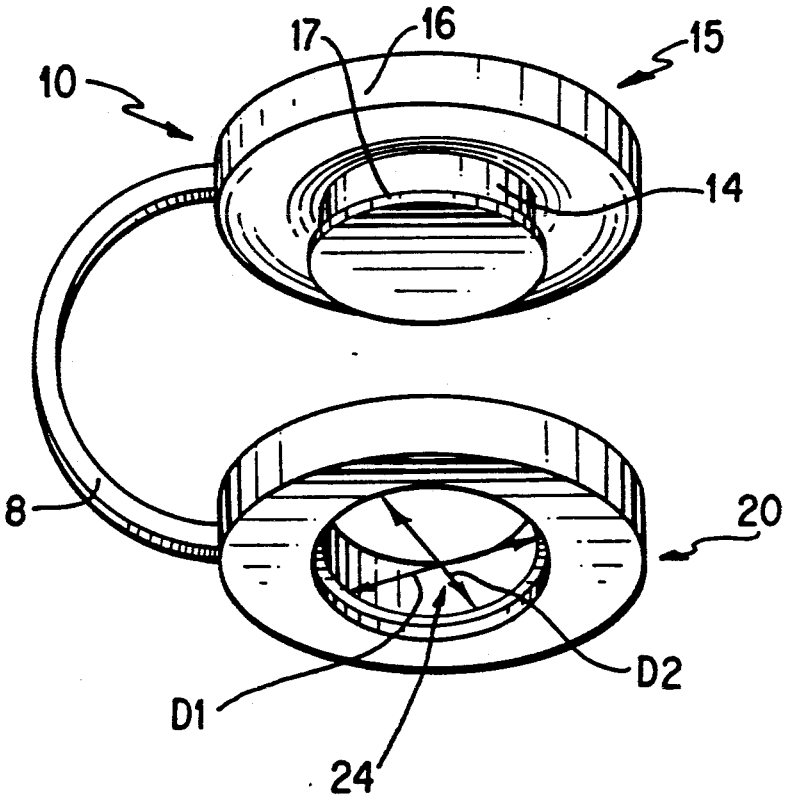
FIG. 1 is a frontal perspective view of the fastening device illustrating the embodiment having a disc and cooperating interengaging means associated with the stud and socket components respectively and showing the aperture somewhat deformed toward a circular cross-section with a diameter of about the diameter of the disc interengaging means.
Figure 2:
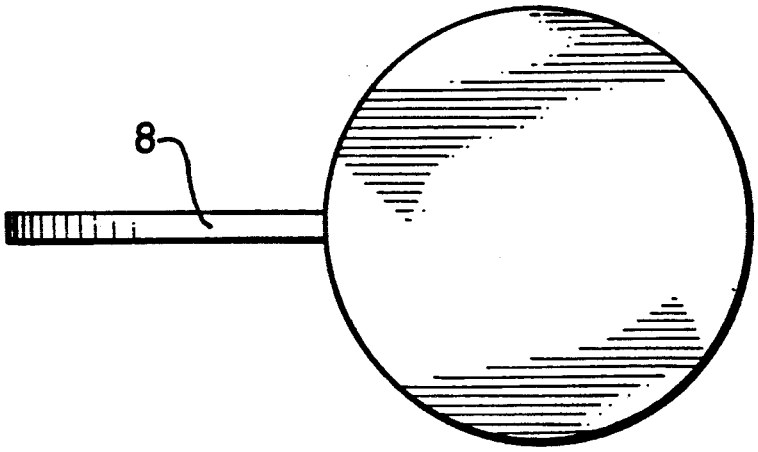
FIG. 2 is a top view of the fastening device illustrating the substantially circular body portion of the stud component and the flexible connector connecting the stud and the socket components.
Figure 3:
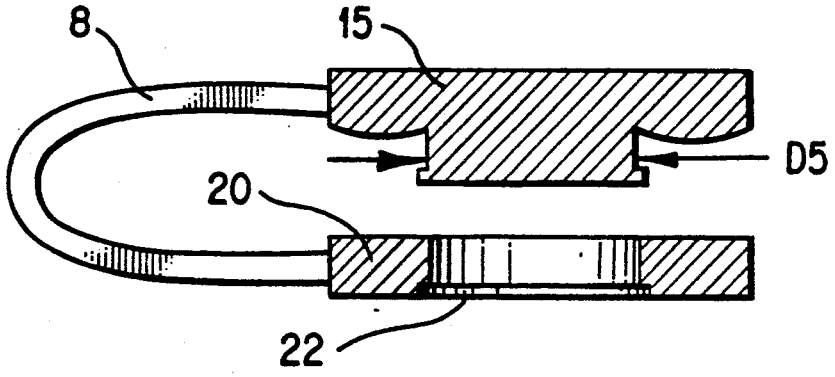
FIG. 3 is an cross section view of the fastening device illustrating a slightly curved first inner surface adapted to clamp material between such surface and the socket component along with a cross section of the stud member and the aperture showing the cooperating interengaging means of the stud and the socket components and that the minor axis of the aperture is shown to be not more than the stud diameter.
Figure 4:
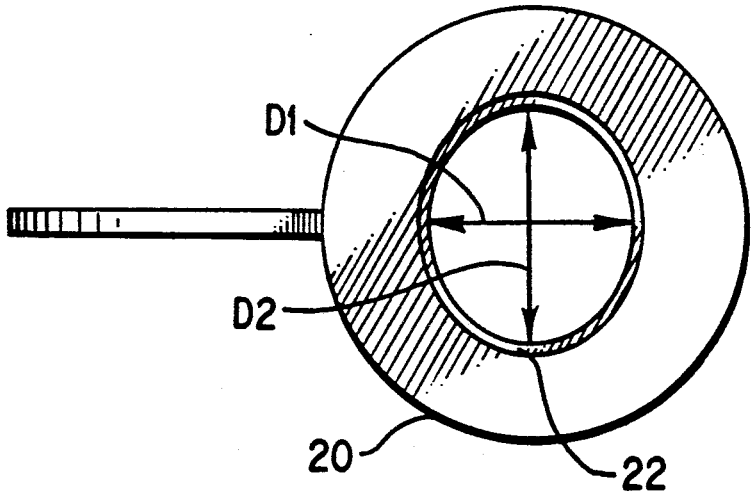
FIG. 4 is a bottom view of the fastening device illustrating the cross section of the aperture and the recess or ledge into which the disc interengaging means fits when the two components are interengaged.
Figure 5:
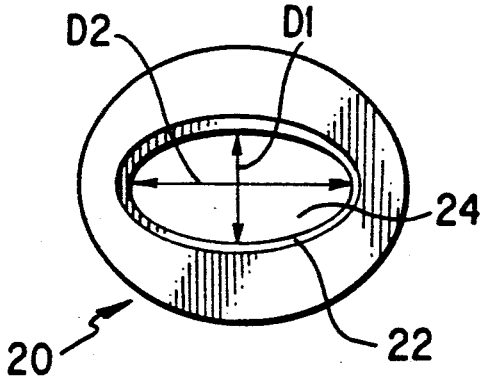
FIG. 5 is a bottom view of the fastening device illustrating the cross section of the aperture and the recess or ledge into which the disc interengaging means fits when the two components are interengaged and further showing the major and minor axes dimensions.
Figure 6:
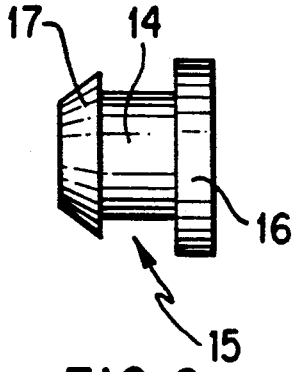
FIG. 6 is a side view of the stud component of the fastening device illustrating the substantially circular body portion of the stud component, the stud member, and the stud interengaging means comprised of a tapered section.
Figure 7:
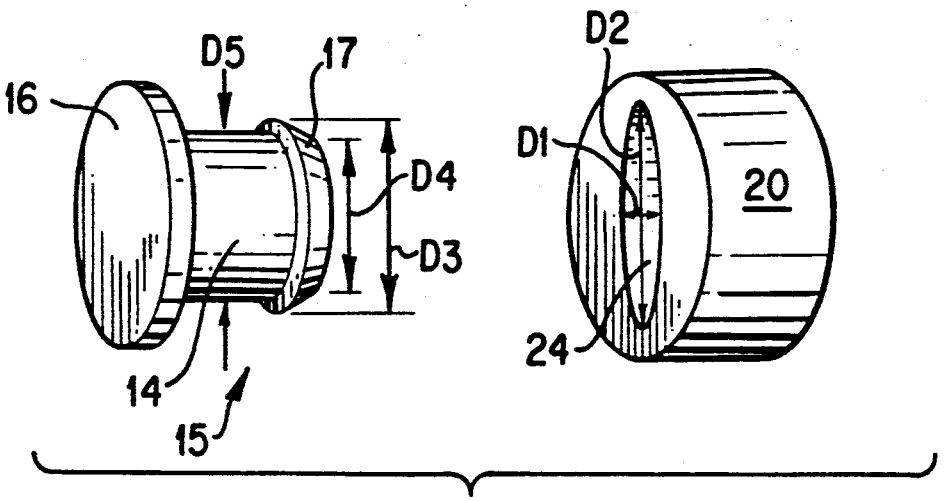
FIG. 7 is a perspective view of the fastening device illustrating the stud component and the socket component.
Figure 8:
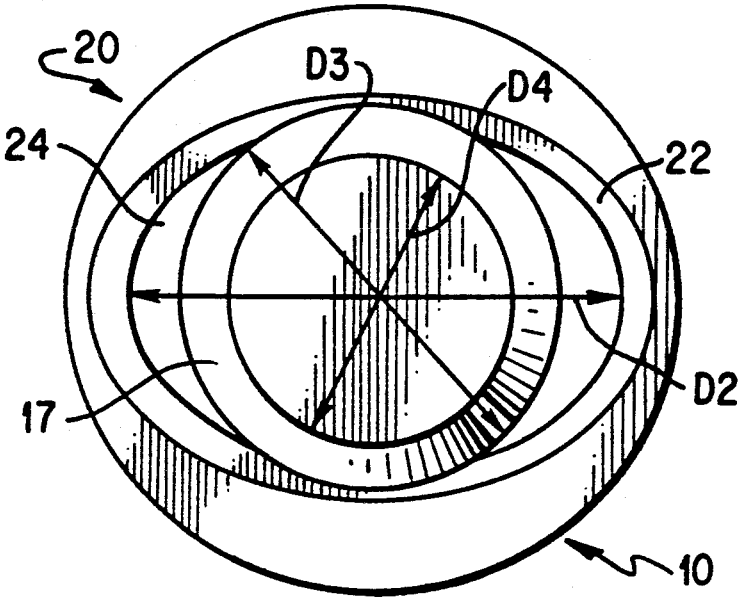
FIG. 8 is a bottom view of the fastening device illustrating the stud component and the socket components inn an interengaged state.

Reference is now made to FIGS. 1–8 all of which depict an embodiment of the fastening device 10 of the invention. The stud component 15 has a substantially cylindrical shaped stud member 14 which extends about vertically from a body portion 16. In the embodiment illustrated in the various drawing figures there is also a disc interengaging means 17 which is adapted to interengage or interconnect with a cooperating means for interengaging 22 which engages disc 17 when the stud and the socket components 15 and 20 are interfitted. I.e., the stud component 15 is pressed into the aperture 24 of socket component 20 deforming the aperture 24 by increasing the minor axis dimension D1 and correspondingly decreasing the major axis dimension D2 and the disc 17 interengages with the corresponding recess 22. The extent of the contact between disc 17 and recess 22 is a function of the dimensions D1 and D2 relative to the stud diameter D5. It is desirable that one-half of the sum of D1 and D2 be greater than or equal to the inner diameter D3 and D1 be less than stud diameter D5 but at the same time greater than outer diameter D4. The disc 17 is tapered in that the inner diameter D3 is larger than the outer diameter D4 and D3 is larger than the stud diameter D5. It is also desirable, in order to permit relatively easy assembly or clamping of the two components, to have the outer diameter D4 be less than the minor axis dimension D1. The difference between D3 and D4 is the taper or means for deforming aperture 24. When the stud component 15 is deformingly inserted into aperture 24 of component 20, the disc 17 will snappingly interengage with recess 22. The properties of the material from which component 20 is made and the forces created by the deformation of the aperture 24 firmly interengage or interconnect components 15 and 20. If relatively flexible or soft material such as paper or cloth is positioned between components 15 and 20 prior to them being interengaged, such material may be clipped or snapped together by forcibly pushing component 15 onto the material and into aperture 24 until disc 17 engages recess 24 and "pinching" the material between the two components 15 and 20.

Device 10 may also be used by inserting stud member 14 and disc 17 into a hole made in material which material may be but need not be flexible. The component 20 is pressed onto stud member 14 and caused to interengage with component 15. Thus a plurality of sheets of the material may be caused to be attached. The number and the thickness of the sheets of material which may be attached together will depend upon the length dimensions of the stud member 14 and the depth of aperture 24. That is to say, the stud component 15 and the socket component 20 may be adapted in any number of dimensional ways to make device 10 useful as a fastening means for various purposes. A first inner surface 13 of body portion 16 may be designed with various surface finishes and radii adapted to more effectively clamp the material. The particular shape and surface condition of surface 13 will depend of the function of the fastening device 10. Device 10 may be adapted for the attachment of objects together such as attaching an object to a wall which object is not to be permanently attached. The object so attached may be easily and non-damagingly removed by simply squeezing component 20 in a manner which decreases D2 and increases D1 to the point where disc 17 releases from recess 22 and component 20 may be easily taken off of component 15.

At this point it should be clearly noted that the so-called interengaging means may be comprised of frictional forces which exist between the surface of the stud member 14 and the surface of the walls defining the aperture 24. When aperture 24 is deformed by the forceable insertion of stud member 14 (which need not have disc 17 at the end thereof, but instead may have a taper so that the small diameter end is easily insertable into aperture 24 because the small diameter is less than the minor axis dimension D1), forces which result from the deformation of aperture 24—and of course component 20 is considered also to have been deformed—and which forces are also related to the material characteristics of component 20 act to interengage the two components 15 and 20. The surface of the stud member 14 and the surface of the walls defining the aperture 24 may be treated such as having serrates which will enhance the interengagement. In this instance it is desirable that one-half of the sum of D1 and D2 be greater than or equal to the stud diameter D5 and D1 being less than D5. Such means for interengaging are not illustrated however are within the scope of the invention herein disclosed and claimed.

As easy as it is to cause the interengagement of the two components 15 and 20 and the possible clamping of a plurality of sheets of material such as paper, it is as easy to disengage the components 15 and 20. By simply squeezing component 20 in a manner which decreases D2 and increases D1 to the point where disc 17 releases from recess 22, component 20 may be easily taken off of component 15. A very important advantage of device 10 is that, for interengaging and for disengaging of the two components 15 and 20, a person need have access to only one component—the socket component 20. Thus items or objects may be attached to a wall in which stud components 15 are incorporated by simply clamping the objects or items using socket components 20. The objects may be easily removed by appropriately pinching component 20 thereby releasing the interengaging means and freeing the object. The device 10 can also be used for purposes similar to the purpose of paper clips except that device 10 may be used anywhere, i.e., it is not restricted in used to the periphery of the items or sheets of paper being attached together.

The instant device 10 could also be used to attach two objects when the stud component 15 is attached to one object and the socket component 20 is attached to the second object, for example the snap closure for a garment and the like.

It is thought that the present invention, the method and the fastening device as disclosed herein and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A fastening device comprising:

a stud component;

a socket component fabricated using material which is resilient but form retaining having a dimensionally deformable substantially elliptical shaped aperture therein adapted to receive and interengage said stud component when said stud component is inserted into said socket component;

said stud component and said socket component adapted to clamp material between them when said stud component is inserted into said socket component;

said stud component comprising a body portion, a substantially cylindrical shaped stud member projecting therefrom and means for deforming said aperture causing said aperture to receive and interengage said stud component when said stud component is inserted into said socket component thereby interconnecting said stud and said socket component;

interengaging means adapted to cooperate with said socket component to interengage said stud and said socket components; and said socket component aperture having interior walls, a major axis dimension and a minor axis dimension, said major axis dimension being greater than said minor axis dimension, said aperture axes dimensions deformable so that said minor axis dimension increases as said major axis dimension decreases upon inserting and extracting of said stud component into and from said socket component and upon squeezing of said socket component along a direction parallel to said major axis and perpendicular to said minor axis of said elliptical shaped aperture, said interengagement of said socket component with said stud component being only at both ends of said minor axis when said stud component is in interengagement with said socket component.

2. The fastening device according to claim 1 wherein said interengaging means comprises appropriately treated surfaces of said stud member and said interior walls defining said aperture such that stud and socket interengagement results from friction forces between tangential contacting areas of said treated surfaces and said interior walls when said stud component is deformingly inserted into said socket component, said forces created by said deformation of said aperture and said resilience of said material.

3. The fastening device according to claim 2 wherein said means for deforming said aperture comprises an appropriate taper of said aperture interior walls so that said minor axis dimension is increased and said major axis dimension is decreased causing said aperture to admit said stud member thus interengaging said stud and said socket component.

4. The fastening device according to claim 3 wherein said stud component is fabricated using material which is resilient but form retaining.

5. The fastening device according to claim 1 wherein said interengaging means comprises:

a disc interengaging means integral with and at the protruding end of said stud member, said disc interengaging means having an inner and an outer diameter said inner diameter being greater than said outer diameter and greater than said stud diameter; and said socket component adapted to have a means for engagement which matingly cooperates with said disc interengaging means of said stud component, said stud and socket interengagement results from forces between tangential contacting areas of said disc interengaging means and said means for engagement of said socket component when said stud component is deformingly inserted into said socket component causing deformation of said aperture, said forces created by said deformation of said aperture and said resilience of said material.

6. The fastening device according to claim 5 wherein said means for deforming said aperture comprises an appropriate thickness dimension and inner and outer diameter relationship of said disc interengaging means providing an adequate taper to cause said aperture deformation upon inserting of said stud component.

7. The fastening device according to claim 6 wherein said stud component is fabricated using material which is resilient but form retaining.

8. The fastening device according to claim 7 further comprising means for flexibly connecting said stud component to said socket component.

9. A fastening device comprising:

a stud component having a body portion, a substantially cylindrical shaped stud member with a vertical length and a stud diameter and extending substantially vertically from a first inner surface and a disc interengaging means integral with and at the protruding end of said stud member, said disc interengaging means having an inner and an outer diameter said inner diameter being not less than said outer diameter and greater than said stud diameter;

a socket component fabricated using material which is resilient but form retaining adapted to interfit and interengage with said stud component, having an arcuate interior aperture surface defining a substantially elliptical shaped aperture through said socket component with a vertical aperture axis substantially in parallel alignment with said stud member, said elliptical shaped aperture having a vertical length being not greater than said stud member length, a minor axis having a dimension greater than said outer diameter of said disc interengaging means and not greater than said stud diameter, and a major axis dimension greater than and orthogonal to said minor axis, one-half the sum of said major and minor axes dimensions being greater than said inner diameter and both said axes orthogonal to said vertical aperture axis, said elliptical shaped aperture axes dimensions deformable so that said minor axis dimension increases as said major axis dimension decreases upon inserting and extracting of said stud component into and from said socket component and upon squeezing of said socket component along a direction parallel to said major axis and perpendicular to said minor axis of said elliptical shaped aperture, said interengagement of said socket component with said stud component being only at both ends of said minor axis when said stud component is in interengagement with said socket component; and said stud component and said socket component adapted to clamp material between them when said stud component is inserted into said socket component.

10. The fastening device according to claim 9 wherein said stud component is fabricated using material which is resilient but form retaining.

11. The fastening device according to claim 10 further comprising said socket component adapted to have a means for engagement which matingly cooperates with said disc interengaging means of said stud component, said stud and socket interengagement results from forces between tangential contacting areas of said disc interengaging means and said means for engagement of said socket component when said stud component is deformingly inserted into said socket component causing deformation of said aperture, said forces created by said deformation of said aperture and said resilience of said material.

12. The fastening device according to claim 11 further comprising means for flexibly connecting said stud component to said socket component.

13. A method for engageably and releasably attaching together two components, a stud component and a socket component said socket component having a substantially elliptical shaped aperture therein, said stud component comprising a body portion, a substantially cylindrical shaped stud member projecting therefrom, means for deforming said aperture when said stud component is inserted into said socket component, said socket component fabricated using material which is resilient but form retaining and each said components adapted with cooperating, interfitting, interengaging means said method comprising the steps of:

deformingly inserting said cylindrical shaped stud member into said substantially elliptical aperture causing said aperture to deform to receive said cylindrical shaped stud member said deformation of said aperture and said resilient material providing forces which causes said interengaging means to interengage said stud and said socket components; and squeezing said socket component along a direction parallel to a major axis and perpendicular to a minor axis of said elliptical shaped aperture in a manner so as to deform said aperture and release said forces thus releasing said interengaging means, said aperture deformation being from a substantially elliptical shaped aperture to an aperture which is sized to allow the removal of said stud component from said socket component without said stud component being subjected to any substantial tensile stresses and insertion of said stud component into said socket component without said stud component being subjected to any substantial compression stresses.

* * * * *